US012043948B2

(12) United States Patent
Choi et al.

(10) Patent No.: US 12,043,948 B2
(45) Date of Patent: Jul. 23, 2024

(54) CLOTHES CARE APPARATUS

(71) Applicant: Samsung Electronics Co., Ltd., Suwon-si (KR)

(72) Inventors: Jungsang Choi, Suwon-si (KR); Jaeryong Park, Suwon-si (KR); Chulkie Park, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 992 days.

(21) Appl. No.: 16/900,179

(22) Filed: Jun. 12, 2020

(65) Prior Publication Data

US 2020/0392664 A1 Dec. 17, 2020

(30) Foreign Application Priority Data

Jun. 13, 2019 (KR) ..... 10-2019-0070231

(51) Int. Cl.
*D06F 58/10* (2006.01)
*D06F 34/14* (2020.01)
(Continued)

(52) U.S. Cl.
CPC ..... *D06F 58/10* (2013.01); *D06F 34/14* (2020.02); *D06F 58/24* (2013.01); *D06F 87/00* (2013.01);
(Continued)

(58) Field of Classification Search
CPC ..... D06F 58/10; D06F 34/14; D06F 58/24; D06F 87/00; D06F 2103/58; D06F 2105/58; D06F 2105/62; D06F 58/30; D06F 58/38
(Continued)

(56) References Cited

U.S. PATENT DOCUMENTS 11,965,281 B2 4/2024 Park et al.
2011/0005279 A1* 1/2011 Yoo ..... D06F 34/22 68/5 C
(Continued)

FOREIGN PATENT DOCUMENTS

CN 112080915 A * 12/2020
JP 3613843 11/2004
(Continued)

OTHER PUBLICATIONS

Office Action dated Apr. 9, 2024 issued in Korean Application No. 10-2019-0070231.

*Primary Examiner* — John P McCormack
(74) *Attorney, Agent, or Firm* — STAAS & HALSEY LLP

(57) ABSTRACT

A clothes care apparatus in which a drain flow passage and a recovery flow passage are configured independently of each other. The clothes care apparatus includes a main body, a heat exchanger disposed inside the main body and configured to condense air inside the main body, a water collecting duct configured to collect water condensed on the heat exchanger, a pump configured to pump out the water collected in the water collecting duct, a drain container configured to store the pumped water introduced from the water collecting duct by the pump and including an inlet through which water is introduced and an overflow hole disposed below the inlet and configured to discharge the stored water in the drain container, and a water level sensor disposed inside the drain container, configured to detect a water level in the drain container, and disposed below the overflow hole.

15 Claims, 16 Drawing Sheets

(51) Int. Cl.

| | |
|---|---|
| ***D06F 58/24*** | (2006.01) |
| ***D06F 87/00*** | (2006.01) |
| *D06F 103/58* | (2020.01) |
| *D06F 105/58* | (2020.01) |
| *D06F 105/62* | (2020.01) |

(52) U.S. Cl.
CPC ..... *D06F 2103/58* (2020.02); *D06F 2105/58* (2020.02); *D06F 2105/62* (2020.02)

(58) Field of Classification Search
USPC ..... 34/75; 62/291
See application file for complete search history.

(56) References Cited

U.S. PATENT DOCUMENTS

2011/0284436 A1* 11/2011 Shin ..... C02F 9/20 210/143
2016/0083894 A1* 3/2016 Bison ..... D06F 58/22 34/85
2016/0115643 A1* 4/2016 Bison ..... D06F 58/24 34/75
2016/0265795 A1* 9/2016 Kopp ..... B01F 23/20
2020/0003217 A1* 1/2020 Wilds ..... F04D 15/0016

FOREIGN PATENT DOCUMENTS

| | | |
|---|---|---|
| JP | 2007-3132 | 1/2007 |
| KR | 20-0382168 | 4/2005 |
| KR | 10-2008-0083995 | 9/2008 |
| KR | 10-2009-0105126 | 10/2009 |
| KR | 10-1362784 | 2/2014 |
| KR | 10-1467776 | 11/2014 |
| KR | 10-2018-0133830 | 12/2018 |

* cited by examiner

CLOTHES CARE APPARATUS

CROSS-REFERENCE TO RELATED APPLICATIONS

This application is based on and claims priority under 35 U.S.C. § 119 to Korean Patent Application No. 10-2019-0070231, filed on Jun. 13, 2019, in the Korean Intellectual Property Office, the disclosure of which is incorporated by reference herein in its entirety.

BACKGROUND

1. Field

The disclosure relates to a clothes care apparatus capable of preventing overflow of water in a drain container.

2. Description of the Related Art

A clothes care apparatus is an apparatus that performs the clothes care, such as drying clothes, removing dust stuck to clothes or odor that has permeated into clothes, and reducing creases of clothes.

The clothes care apparatus may include a heat exchanger configured to supply hot air to a care compartment where clothes are accommodated to dry the clothes, and a steam generation device configured to perform a refresh function such as crease removal, odor removal, and static electricity removal of clothes and the like.

The clothes care apparatus may include a main body for forming the care compartment accommodating clothes. A machine compartment in which the steam generation device, the heat exchanger, and the like are disposed may be disposed below the care compartment. The care compartment and the machine compartment may be separated.

The clothes care apparatus dries clothes accommodated in the care compartment with the heat exchanger provided in the machine compartment, and the air moistened by the drying of the clothes may be dehumidified by the heat exchanger and supplied again to the inside of the care compartment.

The clothes care apparatus may include a drain container for storing condensed water generated during drying of clothes. The drain container is provided detachably from the main body so that a user may discharge water inside the drain container to the outside.

In order to detect a water level in the drain container, a water level sensor may be provided inside the drain container. However, in the conventional technology, when the water level sensor is malfunctioning, there is no method of detecting the malfunction. Therefore, the user may not recognize the malfunction of the water level sensor.

In addition, when a malfunction occurs in the water level sensor inside the drain container, water collected in the drain container may overflow to the outside of the drain container. A recovery flow passage is required to move the water overflowed outside the drain container into the main body when such water overflow occurs.

SUMMARY

It is an aspect of the disclosure to provide a clothes care apparatus capable of detecting a malfunction of a water level sensor disposed inside a drain container and notifying a user of the malfunction.

It is another aspect of the disclosure to provide a clothes care apparatus in which a drain flow passage for delivering water from a duct to a drain container and a recovery flow passage for delivering water from the inside of the drain container to the duct are provided, and the drain flow passage and the recovery flow passage are independent of each other.

Additional aspects of the disclosure will be set forth in part in the description which follows and, in part, will be apparent from the description, or may be learned by practice of the disclosure.

In accordance with an aspect of the disclosure, a clothes care apparatus includes a main body, a heat exchanger disposed inside the main body and configured to condense moist air inside the main body, a water collecting duct configured to collect water condensed on the heat exchanger, a pump configured to pump out the water collected in the water collecting duct, a drain container configured to store the pumped water introduced from the water collecting duct, and the drain container including an inlet through which the pumped water is introduced; and an overflow hole disposed below the inlet and configured to discharge the stored water in the drain container, and a water level sensor disposed inside the drain container, configured to detect a water level in the drain container, and disposed below the overflow hole.

The clothes care apparatus may further include a first flow passage through which the pumped water is introduced into the drain container from the water collecting duct through the inlet, and a second flow passage through which the stored water is discharged from the drain container to the water collecting duct through the overflow hole.

The first flow passage and the second flow passage may be independent of each other.

The first flow passage may include a first hose extending from the water collecting duct to the pump and a second hose extending from the pump to the inside of the drain container.

The inlet may be formed at one end of the second hose.

The drain container may further include an opening formed in parallel with the overflow hole, and a sealing member having a through hole through which the second hose is inserted, the sealing member being inserted into and coupled to the opening to seal the opening.

The second hose may be configured to be withdrawn from the through hole when the drain container is separated from the main body.

The second hose may be configured to be inserted into the through hole when the drain container is coupled to the main body.

A diameter of the through hole may be larger than an outer diameter of the second hose so as not to hinder the second hose from being inserted into or withdrawn from the through hole.

The clothes care apparatus may further include a flow passage connector coupled to a rear of the drain container to correspond to the sealing member and the overflow hole and configured to guide the stored water to be discharged downward to the outside of the drain container through the overflow hole.

The second flow passage may include a third hose connecting an outlet formed on a bottom surface of the flow passage connector to the water collecting duct to discharge water introduced into an inner space of the flow passage connector through the overflow hole.

The water collecting duct may be a first water collecting duct and the clothes care apparatus may further include a second water collecting duct disposed below the first water collecting duct to receive and the collected water discharged from the first water collecting duct.

The clothes care apparatus may further include a connecting hose connecting the first water collecting duct and the second water collecting duct to guide the water collected in the first water collecting duct to the second water collecting duct.

The clothes care apparatus may further include a partition wall covering a periphery of the overflow hole to prevent water inside the drain container from being discharged through the overflow hole when the drain container is separated and moved from the main body.

The partition wall may include side walls, a front wall connecting the side walls, respectively, and facing the overflow hole, and a bottom wall connecting the side walls and the front wall, respectively.

An open upper side of the partition wall may be disposed below the inlet.

The water level sensor may include a first water level sensor and a second water level sensor arranged side by side with each other.

The water level sensor may include a floating magnet provided to be movable up and down according to the water level in the drain container, a detection sensor disposed to face the floating magnet at a selected position to detect a distance from the floating magnet, and a magnet housing configured to accommodate the floating magnet.

The clothes care apparatus may further include a controller configured to control the clothes care apparatus to stop performing an operation of the clothes care apparatus when one or more of the first water level sensor and the second water level sensor detect that the water level in the drain container reaches a full water level.

The clothes care apparatus may further include a display configured to display a status of the clothes care apparatus.

The controller may control the display to display information on the display that the first water level sensor is not operating normally when the first water level sensor does not detect the full water level and the second water level sensor detects the full water level, or that the second water level sensor is not operating normally when the first water level sensor detects the full water level and the second water level sensor does not detect the full water level.

In accordance with another aspect of the disclosure, a clothes care apparatus includes a main body, a heat exchanger disposed inside the main body and configured to condense air inside the main body, a water collecting duct configured to collect water condensed on the heat exchanger, a pump configured to pump out the water collected in the water collecting duct, a drain container configured to store the pumped water introduced from the water collecting duct, a first water level sensor disposed inside the drain container and configured to detect whether a water level in the drain container reaches a full water level, a second water level sensor disposed in parallel with the first water level sensor in the drain container and configured to detect whether the water level in the drain container reaches the full water level, and a controller configured to control the clothes care apparatus to stop performing an operation of the clothes care apparatus when one or more of the first water level sensor and the second water level sensor detect that the water level in the drain container reaches the full water level.

The clothes care apparatus may further include a display configured to display a status of the clothes care apparatus.

The controller may control the display to display information on the display that the first water level sensor is not operating normally when the first water level sensor does not detect the full water level and the second water level sensor detects the full water level, or that or the second water level sensor is not operating normally when the first water level sensor detects the full water level and the second water level sensor does not detect the full water level.

Each of the first water level sensor and the second water level sensor may include a floating magnet provided to be movable up and down according to the water level in the drain container, a detection sensor disposed to face the floating magnet at a selected position to detect a distance from the floating magnet, and a magnet housing configured to accommodate the floating magnet.

In accordance with another aspect of the disclosure, a clothes care apparatus includes a main body, a heat exchanger disposed inside the main body and configured to condense air inside the main body, a water collecting duct configured to collect water condensed on the heat exchanger, a pump configured to pump out the water collected in the water collecting duct, a drain container configured to be separable from the main body and to be supplied with water collected in the water collecting duct by the pump and store the supplied water, a first flow passage through which the stored water is delivered from the water collecting duct to the drain container, and a second flow passage through which the stored water is delivered from the drain container to the water collecting duct and provided independently of the first flow passage.

The clothes care apparatus may further include a first water level sensor disposed inside the drain container and configured to detect whether a water level in the drain container reaches a full water level, and a second water level sensor disposed in parallel with the first water level sensor in the drain container and configured to detect whether the water level in the drain container is the full water level.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
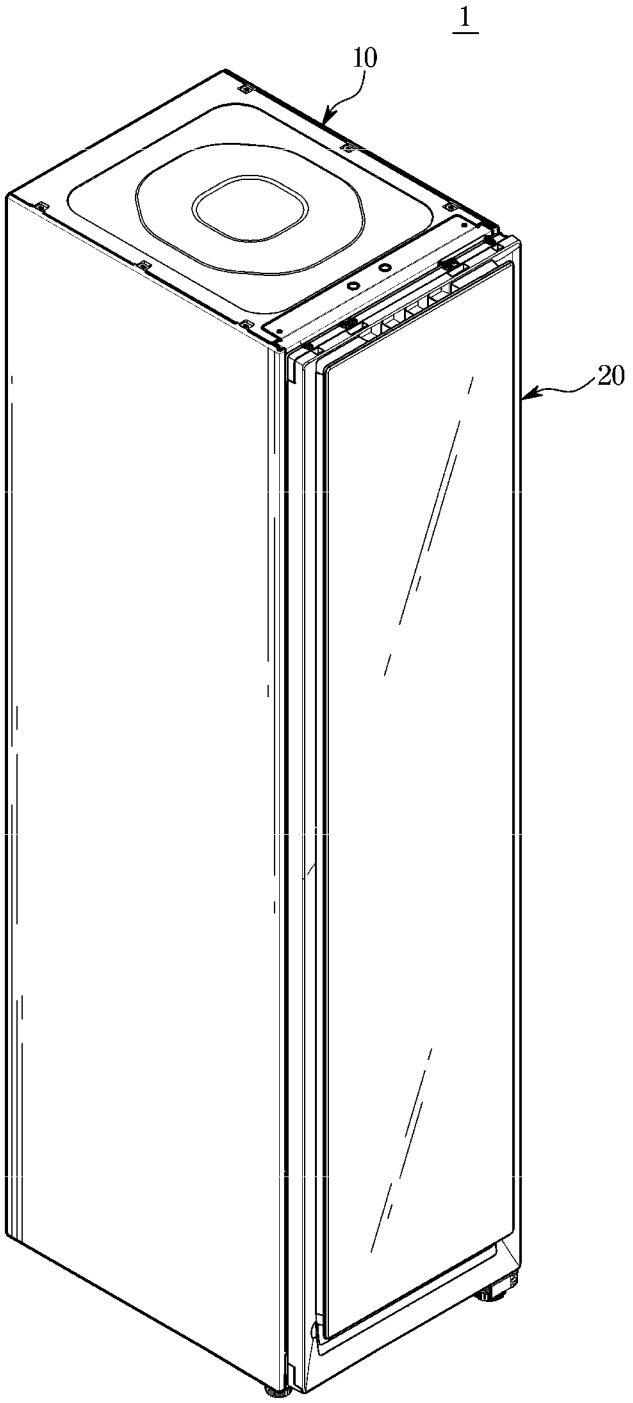
FIG. 1 is a perspective view of a clothes care apparatus according to an embodiment of the disclosure.

The embodiments described herein and the configurations shown in the drawings are only examples of preferred embodiments of the disclosure, and various modifications may be made at the time of filing of the disclosure to replace the embodiments and drawings of the present specification.

The terms used herein are for the purpose of describing the embodiments and are not intended to restrict and/or to limit the disclosure. For example, the singular expressions herein may include plural expressions, unless the context clearly dictates otherwise. The terms "comprises" and "has" are intended to indicate that there are features, numbers, steps, operations, elements, parts, or combinations thereof described in the specification, and do not exclude the presence or addition of one or more other features, numbers, steps, operations, elements, parts, or combinations thereof.

It will be understood that, although the terms first, second, etc. may be used herein to describe various components, these components should not be limited by these terms. These terms are only used to distinguish one component from another. For example, without departing from the scope of the disclosure, the first component may be referred to as a second component, and similarly, the second component may also be referred to as a first component.

Hereinafter, embodiments according to the disclosure will be described in detail with reference to the accompanying drawings.

Figure 2:
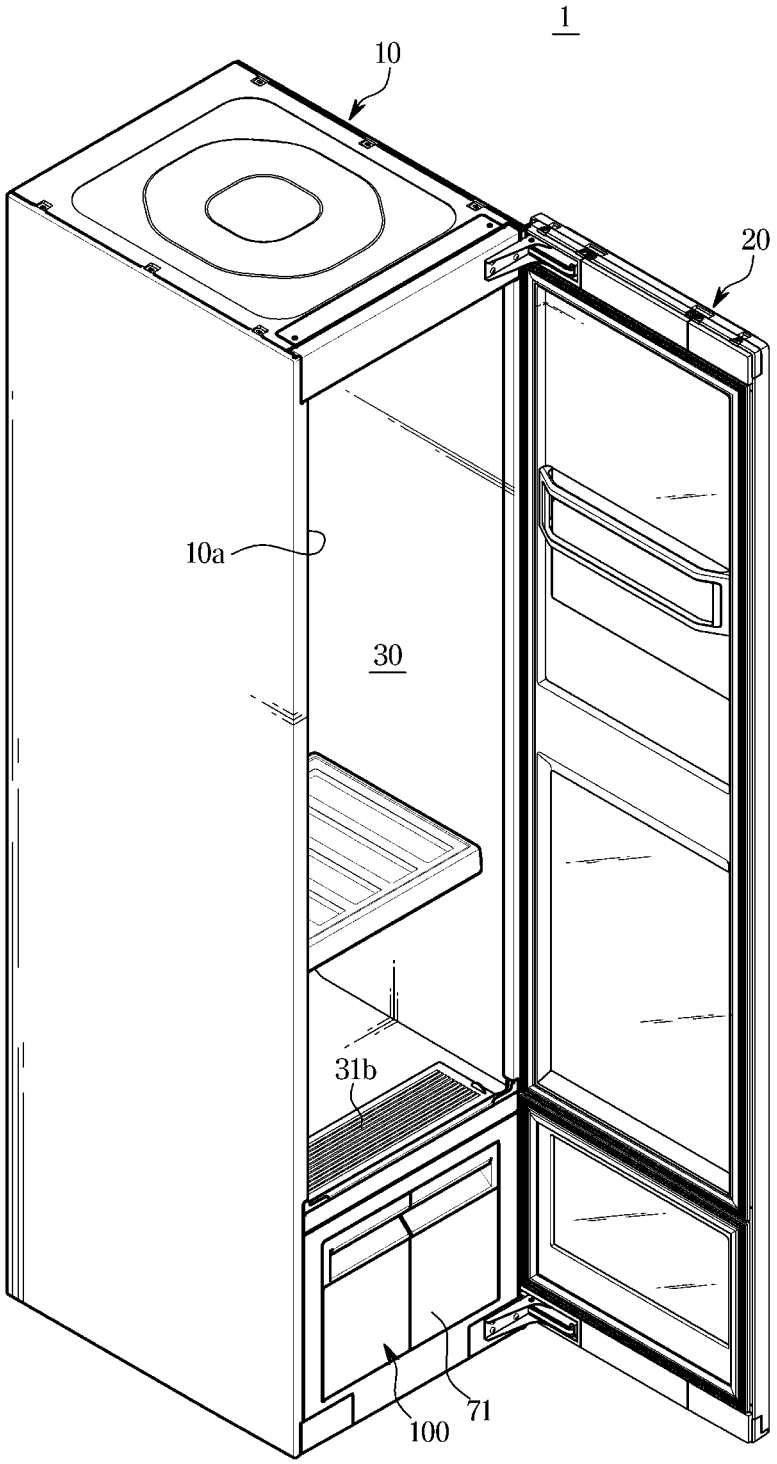
FIG. 2 is a view illustrating a state in which a door of the clothes care apparatus according to an embodiment of the disclosure is opened.

FIG. 1 is a perspective view of a clothes care apparatus according to an embodiment of the disclosure, and FIG. 2 is a view illustrating a state in which a door of the clothes care apparatus according to an embodiment of the disclosure is open.

As illustrated in FIGS. 1 and 2, a clothes care apparatus 1 may include a main body 10 forming an appearance and a door 20 rotatably coupled to the main body 10.

The main body 10 may have a substantially hexahedral shape with a front surface open. An opening 10*a* may be formed on a front surface of the main body 10. The door 20 is rotatably coupled to the main body 10 to open and close the opened front surface of the main body 10. Although not shown in the drawings, the door 20 may be installed to the main body 10 through a hinge or a link.

The main body 10 may include a care compartment 30 provided inside the main body 10 to accommodate and care clothes. The door 20 may open and close the care compartment 30 by opening and closing the opened front surface of the main body 10.

Figure 3:
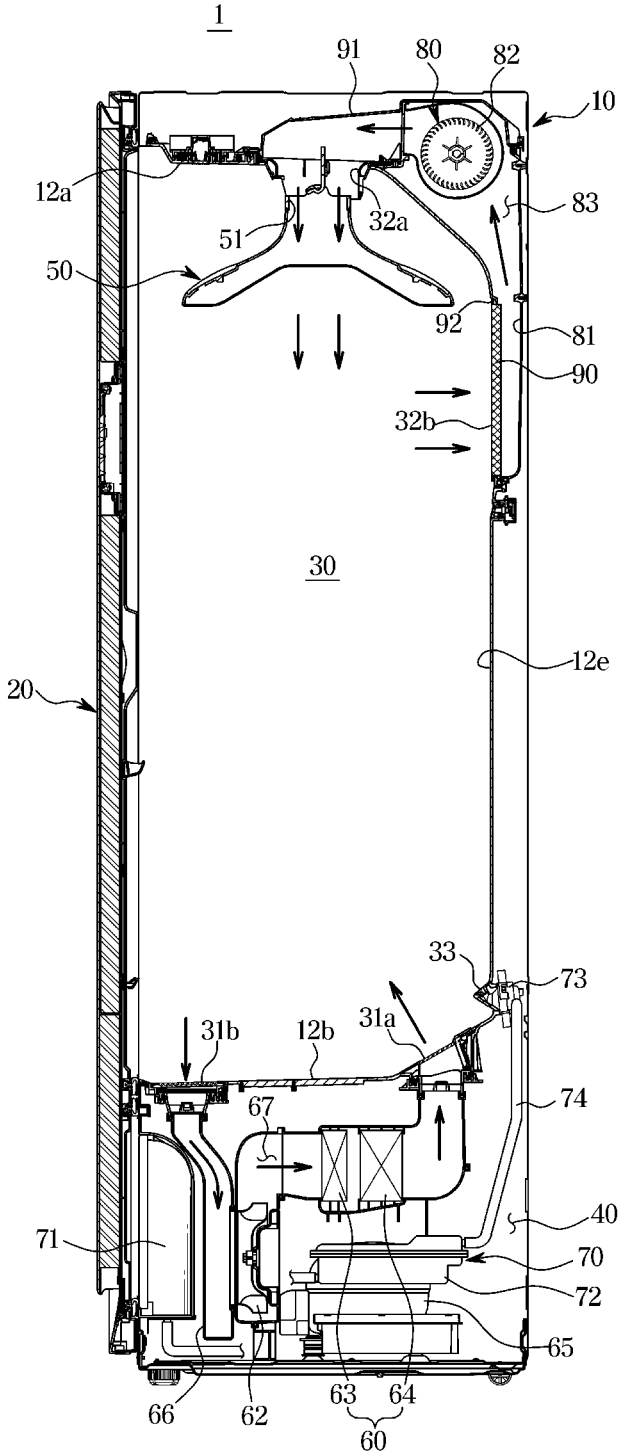
FIG. 3 is a side cross-sectional view of the clothes care apparatus according to an embodiment of the disclosure.
Figure 4:
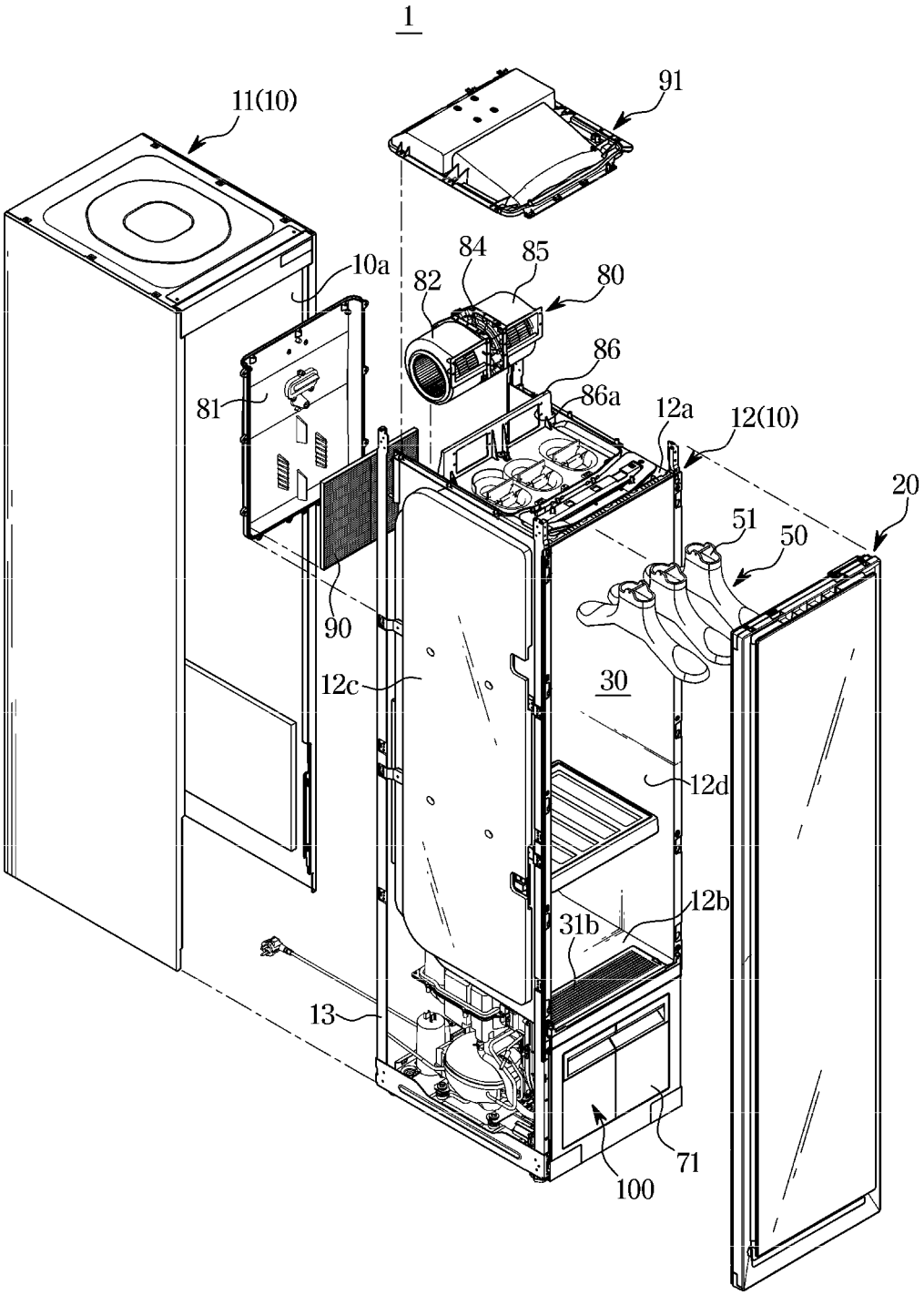
FIG. 4 is an exploded perspective view of the clothes care apparatus according to an embodiment of the disclosure.

FIG. 3 is a side cross-sectional view of the clothes care apparatus according to an embodiment of the disclosure, and FIG. 4 is an exploded perspective view of the clothes care apparatus according to an embodiment of the disclosure.

As illustrated in FIGS. 3 and 4, the main body 10 may include an outer cabinet 11 and an inner cabinet 12 disposed inside the outer cabinet 11. The main body 10 may include a support member 50 provided inside the care compartment 30 to hang clothes.

The main body 10 may include a machine compartment 40 in which a heat exchanger 60 or like provided to dehumidify or heat air in the care compartment 30 is accommodated.

The care compartment 30 may form a space in which clothes are accommodated. The care compartment 30 may include an upper surface 12*a*, a lower surface 12*b*, a left surface 12*c*, a right surface 12*d*, and a rear surface 12*e* provided in the inner cabinet 12.

The inner cabinet 12 may include a frame 13 provided to support the upper surface 12*a*, the lower surface 12*b*, the left surface 12*c*, the right surface 12*d*, and the rear surface 12*e*.

The frame 13 may form the care compartment 30 and the machine compartment 40 disposed below the care compartment 30, but is not limited thereto.

The support member 50 may be installed on the upper surface 12*a* of the care compartment 30. The support member 50 may be detachably installed in the care compartment 30. One or more of the support members 50 may be provided. The support member 50 may be formed in a hanger shape so that clothes may be fitted, but is not limited thereto.

The support member 50 may be provided to allow air to flow through the inside thereof. Dust or foreign substances stuck to the clothes may be removed by the air supplied to the inside of the support member 50.

The support member 50 may be provided with an air hole 51 for supplying air to clothes. The air hole 51 may be formed at an upper end of the support member 50, and air may be supplied to clothes through the air hole 51.

However, the disclosure is not limited to the above configuration, and the air hole 51 may be formed in various sizes at various positions so that the supplied air may be widely injected on clothes.

The care compartment 30 may include a first inlet 31*a*, a second inlet 32*a*, a first outlet 31*b*, a second outlet 32*b*, and a steam inlet 33.

The first inlet 31*a* and the first outlet 31*b* may be formed at the lower surface 12*b* of the care compartment 30. The first inlet 31*a* may be disposed at a rear portion of the lower surface 12*b* of the care compartment 30. The first outlet 31*b* may be disposed at a front portion of the lower surface 12*b* of the care compartment 30. The first inlet 31*a* and the first outlet 31*b* may be disposed adjacent to each other.

The steam inlet 33 may be disposed at a lower portion of the rear surface 12*e* of the care compartment 30. The steam inlet 33 may be disposed above the first inlet 31*a*.

The second inlet 32*a* may be formed at one side of the upper surface 12*a* of the care compartment 30, and the second outlet 32*b* may be formed at one side of the rear surface 12*e* of the care compartment 30.

The second inlet 32*a* of the care compartment 30 may be connected to the support member 50. The air introduced through the second inlet 32*a* may be delivered to the support member 50 through the air hole 51 and may be delivered to the clothes hanging on the support member 50.

A drain container 100 and a water supply container 71 that are detachably provided from the main body 10 may be installed at a lower portion of the main body 10. The drain container 100 and the water supply container 71 may be disposed at a lower portion of the care compartment 30.

The drain container 100 may be provided to facilitate the treatment of condensed water by the heat exchanger 60. The water supply container 71 may store water required to generate steam in a steam generation device 70.

The water in the water supply container 71 may be supplied to the steam generation device 70 and used to generate steam. The water supply container 71 may be detachably installed from the main body 10 to facilitate water replenishment.

The drain container 100 and the water supply container 71 may be provided in the front of the machine compartment 40. The machine compartment 40 may be provided at the lower portion of the main body 10. The machine compartment 40 may be provided at the lower portion of the care compartment 30.

The heat exchanger 60 may be provided to dehumidify and heat air in the care compartment 30 as necessary.

The heat exchanger 60 may be installed to supply hot air into the care compartment 30. The heat exchanger 60 may include an evaporator 63, a condenser 64, and a compressor 65 through which a refrigerant circulates, and may be provided to dehumidify and heat air.

As the refrigerant evaporates in the evaporator 63 of the heat exchanger 60, the evaporator 63 may absorb latent heat of the surrounding air, thereby condensing and removing moisture in the air.

When the refrigerant is condensed in the condenser 64 after passing through the compressor 65, the refrigerant may heat the surrounding air by releasing the latent heat toward the surrounding air.

The evaporator 63 and the condenser 64 perform a heat exchange function, so that the air introduced into the machine compartment 40 by a first fan 62 may be dehumidified and heated by passing through the evaporator 63 and the condenser 64 sequentially.

The heat exchanger 60 installed in the machine compartment 40 may include a first duct 66 connecting the evaporator 63, the condenser 64, and the first fan 62, and the first duct 66 may be connected to the care compartment 30 to form a dehumidifying flow passage 67 that circulates between the care compartment 30 and the first duct 66.

The first duct 66 may be connected to the first inlet 31*a* and the first outlet 31*b* of the care compartment 30. One end of the first duct 66 may be connected to the first inlet 31*a*, and the other end may be connected to the first outlet 31*b*.

The air in the care compartment 30 may be introduced into the first duct 66 through the first outlet 31*b*, and the introduced air may be dehumidified and introduced back into the care compartment 30 through the first inlet 31*a*.

The first inlet 31*a* may be disposed in the rear of the care compartment 30, and the first outlet 31*b* may be disposed in the front of the care compartment 30. However, the disclosure is not limited thereto. For example, the positions of the first inlet 31*a* and the first outlet 31*b* may be variously changed as necessary.

The first duct 66 may be provided to dehumidify the air introduced through the first outlet 31*b* and discharge the dehumidified air to the first inlet 31*a*. The first fan 62 may be provided on the first duct 66 to suck the air in the care compartment 30 into the first duct 66.

The machine compartment 40 may be provided with the steam generation device 70 for receiving water from the water supply container 71 to generate steam.

The steam generation device 70 may include a steam generator 72 connected to the water supply container 71 and receiving water to generate steam, and a steam supply pipe 74 for guiding the generated steam to a steam injector 73. The steam injector 73 may be disposed at the lower portion of the rear surface 12*e* of the care compartment 30.

The steam injector 73 may be formed in a nozzle shape at an end to smoothly inject steam into an inner space of the care compartment 30 and may be installed to be exposed to the inside of the care compartment 30.

The care compartment 30 may include a blowing device 80 for flowing air inside the care compartment 30. The blowing device 80 may include a second duct 81, and a second fan 82 may be installed inside the second duct 81.

The second duct 81 may be provided to be in communication with the care compartment 30 to form a filter flow passage 83 through which air passing through the care compartment 30 and the second duct 81 circulates. The second fan 82 may be disposed on the filter flow passage 83.

The second duct 81 may be formed in the rear of the second outlet 32*b* of the care compartment 30. The second duct 81 may be provided at an upper portion of the rear surface 12*e* of the care compartment 30 and may include a filter 90 therein.

The filter 90 may include a HEPA (High Efficiency Particulate Air) filter, but is not limited thereto.

The second duct 81 may be coupled to a top cover 91 disposed at an upper portion of the care compartment 30. The blowing device 80 may be disposed in the rear of the upper portion of the care compartment 30. The blowing device 80 may include a motor 84 for generating a rotational force and the at least one second fan 82 rotated by the motor 84.

A shaft of the motor 84 protrudes to opposite sides, and the second fans 82 may be coupled to the opposite ends of the shaft, respectively. Through this structure, a pair of the second fans 82 may be rotated by one of the motor 84.

The pair of second fans 82 may be provided as centrifugal fans that suck air in an axial direction and discharge air outward in a radial direction, but are not limited thereto.

The second fans 82 may be accommodated in a fan case 85. The fan case 85 may be coupled to a duct bracket 86 provided on the upper surface 12*a* of the care compartment 30.

At least one duct hole 86*a* may be formed on the duct bracket 86, and the second fans 82 may be coupled to the at least one duct hole 86*a*, respectively, to move air in the second duct 81 to the second inlet 32*a*.

The second duct 81 may be connected to the second inlet 32*a* and the second outlet 32*b* of the care compartment 30. One end of the second duct 81 may be connected to the second inlet 32*a*, and the other end may be connected to the second outlet 32*b* of the care compartment 30.

The second inlet 32*a* may be connected to the support member 50 so that air in the second duct 81 may be delivered to the support member 50.

The second fan 82 disposed inside the second duct 81 may be provided to suck air in the care compartment 30 through the second outlet 32*b* and discharge the sucked air into the second inlet 32*a*.

A filter installation portion 92 for installing the filter 90 may be provided on the rear surface 12*e* of the care compartment 30. The second inlet 32*a* may be formed at a position corresponding to the filter installation portion 92.

The air in the care compartment 30 may be filtered by the filter 90 in the second outlet 32*b* as it enters the second duct 81. Dust and odor in the air introduced into the second duct 81 may be removed by the filter 90.

The air filtered by the filter 90 may be discharged to the support member 50 through the blowing device 80. The filter 90 may include a dust collecting filter (not shown) for removing dust or a means for deodorization.

When clothes are managed in the care compartment 30, the clothes care apparatus 1 may be operated in a state in which the clothes are hung on the support member 50 and the door 20 is closed. Air may circulate through the care compartment 30 via the dehumidifying flow passage 67 and the filter flow passage 83.

Figure 5:
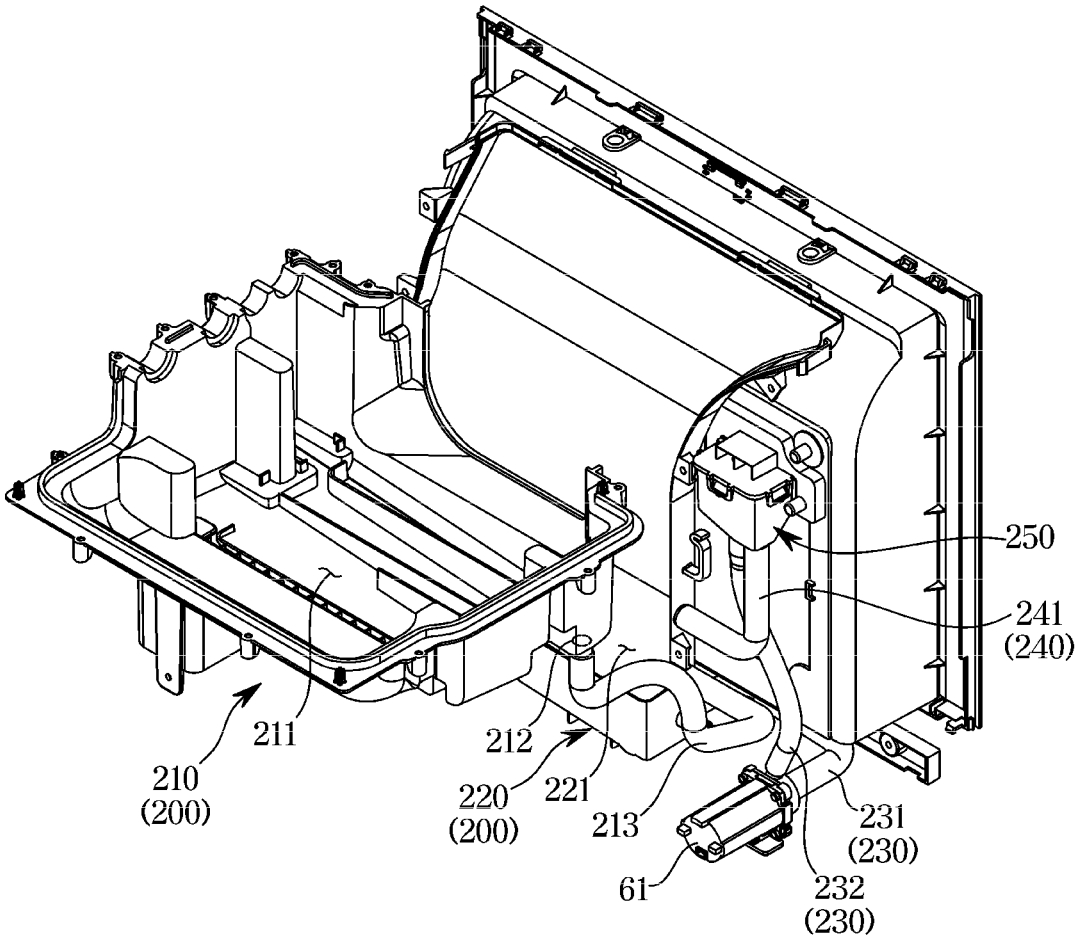
FIG. 5 partially illustrates components disposed in a machine compartment in the clothes care apparatus according to an embodiment of the disclosure.
Figure 6:
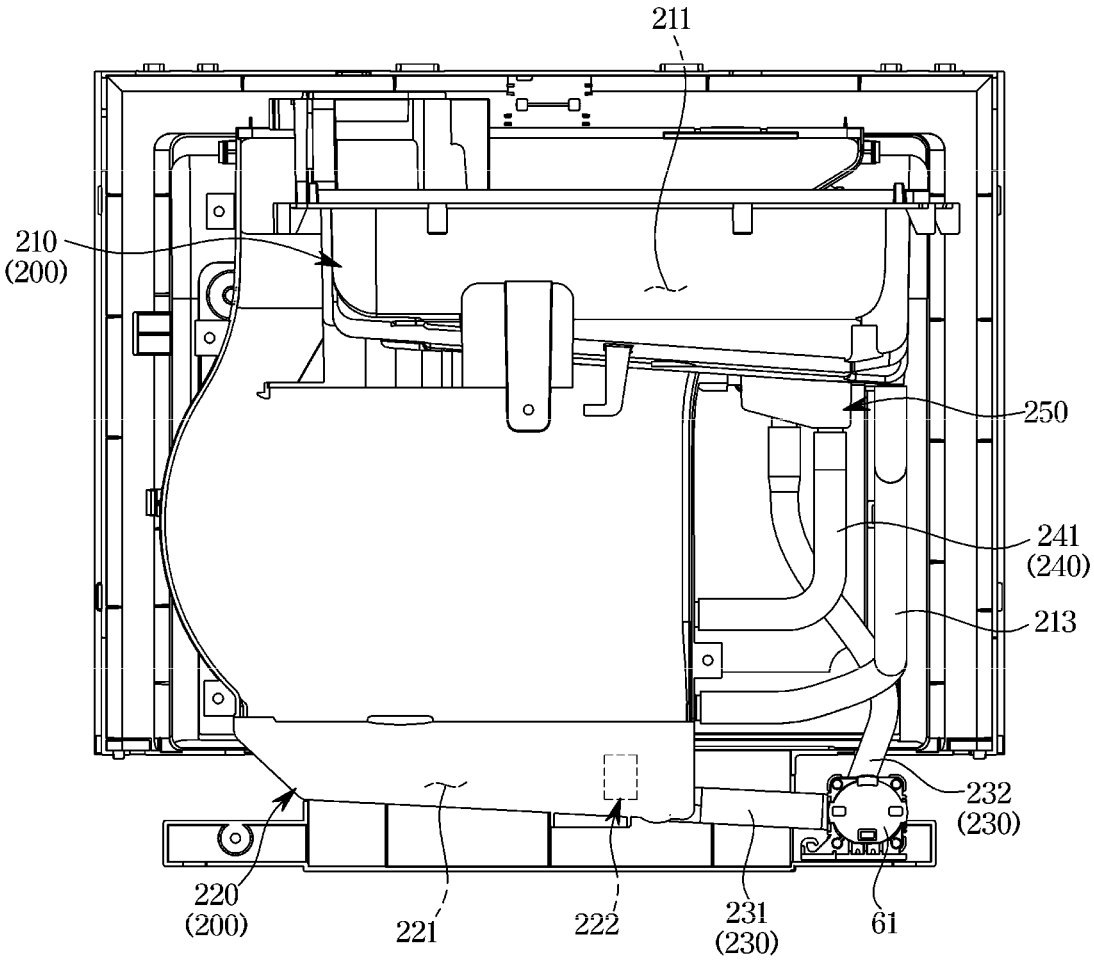
FIG. 6 illustrates the components shown in FIG. 5 from a different angle.

FIG. 5 partially illustrates components disposed in a machine compartment in the clothes care apparatus according to an embodiment of the disclosure, and FIG. 6 illustrates the components shown in FIG. 5 from a different angle.

Referring to FIG. 5, the machine compartment 40 may be provided with a water collecting duct 200 provided to collect water condensed on the heat exchanger 60.

The water collecting duct 200 may include a first water collecting duct 210 provided to accommodate the heat exchanger 60, and a second water collecting duct 220 provided to receive and collect water discharged from the first water collecting duct 210.

The first water collecting duct 210 may include an inner space 211 accommodating the heat exchanger 60 (see FIG. 3) and collecting water condensed on the heat exchanger 60.

The first water collecting duct 210 may include a duct hole 212 provided on one side of the inner space 211. The duct hole 212 may be provided to discharge water collected in the inner space 211 to the outside. In order to discharge the water collected in the inner space 211 without a separate power source, the duct hole 212 may be formed at a lower end of the inner space 211. A bottom surface of the first water collecting duct 210 may be inclined downward toward the duct hole 212. The water collected in the inner space 211 may be guided to the duct hole 212 by the inclined bottom surface.

Referring to FIGS. 5 and 6, the second water collecting duct 220 may be disposed below the first water collecting duct 210. The second water collecting duct 220 may include an inner space 221 like the first water collecting duct 210. A bottom surface of the second water collecting duct 220 may be inclined downward to easily discharge water collected in the inner space 221 of the second water collecting duct 220.

A connecting hose 213 may be provided between the first water collecting duct 210 and the second water collecting duct 220. The connecting hose 213 may be connected to the duct hole 212 of the first water collecting duct 210 and one surface of the second water collecting duct 220. The connecting hose 213 may be provided to deliver the water collected in the first water collecting duct 210 to the second water collecting duct 220. As described above, because the first water collecting duct 210 may be disposed above the second water collecting duct 220 and the bottom surface of the first water collecting duct 210 may be inclined downward toward the duct hole 212, the water condensed on the heat exchanger 60 is guided to the duct hole 212 by the bottom surface inclined toward the duct hole 212 and may be collected in the second water collecting duct 220 through a connecting hose 213.

The clothes care apparatus 1 according to an embodiment of the disclosure may include a pump 61 pumping water collected in the second water collecting duct 220 in order to deliver the water collected in the second water collecting duct 220 to the drain container 100.

The pump 61 may be disposed outside the second water collecting duct 220. Therefore, a first hose 231 connecting the pump 61 disposed outside the second water collecting duct 220 and the second water collecting duct 220 may be provided. One side of the first hose 231 may be connected to a lower end of the second water collecting duct 220, and the other side of the first hose 231 may be connected to the pump 61. The first hose 231 may be disposed to be inclined downward from the second water collecting duct 220 toward the pump 61, but is not limited thereto.

The clothes care apparatus 1 may include a second hose 232 connecting the pump 61 and the drain container 100. The second hose 232 may be provided to deliver water pumped by the pump 61 to the drain container 100. One end of the second hose 232 may be connected to the pump 61, and the other end of the second hose 232 may be connected to the drain container 100. Because the other end of the second hose 232 is disposed higher than the one end of the second hose 232, the pump 61 is required to be operated to move water from the one end of the second hose 232 to the other end of the second hose 232.

A flow passage for delivering water from the second water collecting duct 220 to the drain container 100 is referred to as a first flow passage 230. According to the disclosure, because drainage is performed by sending water inside the main body 10 to the drain container 100 and then emptying the water inside the drain container 100, the first flow passage refers to a drain flow passage.

According to the disclosure, the clothes care apparatus 1 may include a second flow passage 240 for sending water inside the drain container 100 back to the water collecting duct 200. More specifically, the second flow passage 240 may be provided to guide water inside the drain container 100 to the second water collecting duct 220. The second flow passage 240 may include a third hose 241 connecting a flow passage connecting member 250, which will be described later, and the second water collecting duct 220. The second flow passage 240 and the third hose 241 will be described later. As a water level inside the drain container 100 rises, water inside the drain container 100 may be discharged back to the second water collecting duct 220. In this case, water may move through the second flow passage 240. Therefore, hereinafter, the second flow passage 240 refers to a recovery flow passage.

A reference numeral 222 in FIG. 6 indicates a water level sensor. The water level sensor 222 may be provided to detect a water level inside the second water collecting duct 220. When the water level sensor 222 detects that the water level inside the second water collecting duct 220 is greater than or equal to a predetermined water level, the pump 61 may operate. Accordingly, the pump 61 may efficiently pump water collected in the second water collecting duct 220 to the drain container 100 despite intermittent operation.

Figure 7:
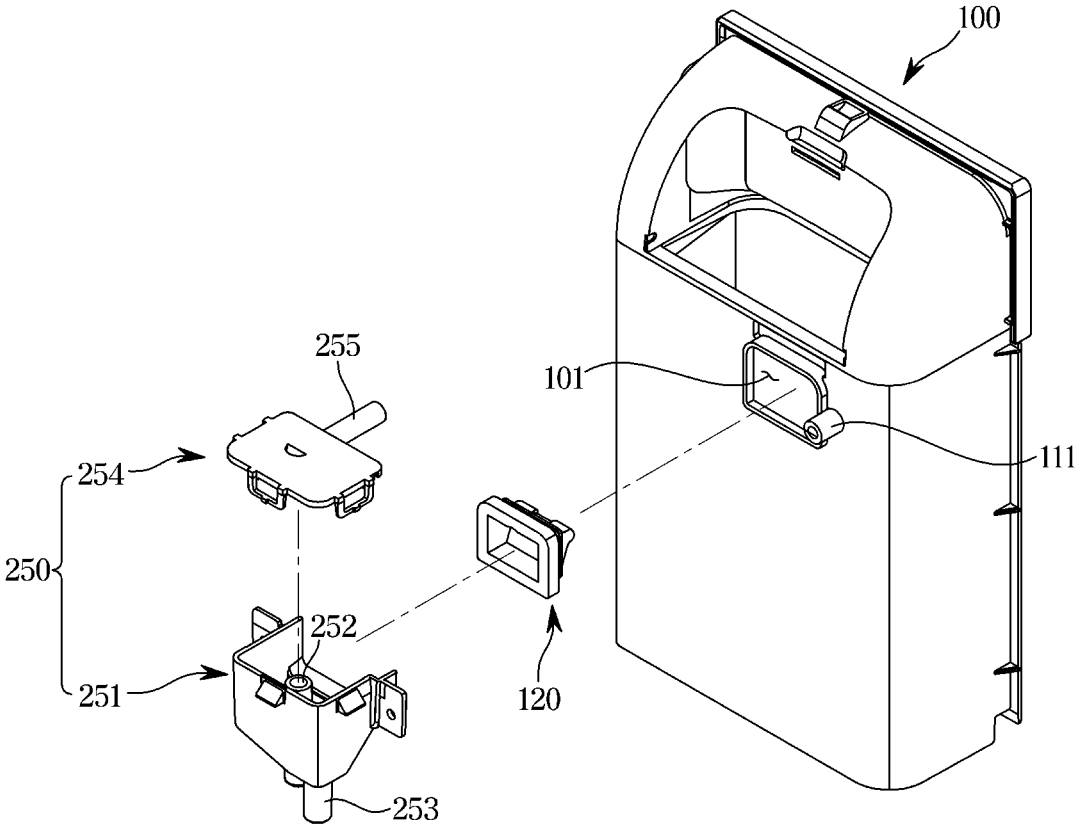
FIG. 7 is an exploded view of a drain container and some components to be coupled to the drain container in the clothes care apparatus according to an embodiment of the disclosure.

FIG. 7 is an exploded view of a drain container and some components to be coupled to the drain container in the clothes care apparatus according to an embodiment of the disclosure.

Referring to FIG. 7, in the clothes care apparatus 1 according to an embodiment of the disclosure, the drain container 100 may include an opening 101 formed on the rear surface thereof, an overflow hole 110 (see FIG. 9) provided in parallel with the opening 101, and a discharge pipe 111 for discharging water introduced into the overflow hole 110 to the rear of the drain container 100. A sealing member 120, which will be described later, may be coupled to the opening 101. The clothes care apparatus 1 may also include the flow passage connecting member 250 to be selectively coupled to the drain container 100.

The flow passage connecting member 250 may be selectively coupled to the drain container 100. When the drain container 100 is separated from the main body 10, the flow passage connecting member 250 may be separated from the drain container 100. When the drain container 100 is coupled to the main body 10, the flow passage connecting member 250 may be coupled to the drain container 100.

The flow passage connecting member 250 may include a body part 251 and a cover part 254. The body part 251 may include a first connecting pipe 252 and a second connecting pipe 253. The cover part 254 may include a third connecting pipe 255. When the drain container 100 is coupled to the main body 10, at least a portion of the third connecting pipe 255 may pass through the sealing member 120 and be disposed inside the drain container 100. The first connecting pipe 252 and the third connecting pipe 253 may be connected to each other. The second connecting pipe 253 may be provided to discharge water discharged from the drain container 100 downward. Hoses and pipes, which will be described below, are only different in terms, and structures thereof are not limited by the terms.

Figure 8:
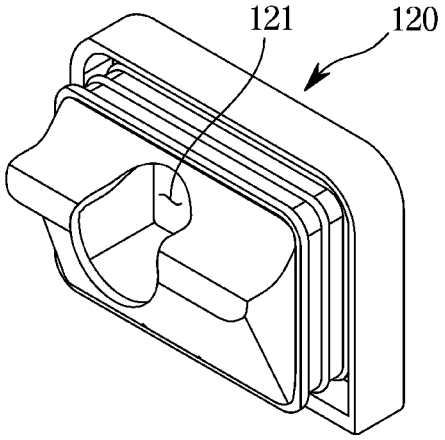
FIG. 8 illustrates a sealing member in the clothes care apparatus according to an embodiment of the disclosure.

FIG. 8 illustrates a sealing member in the clothes care apparatus according to an embodiment of the disclosure.

Referring to FIG. 8, the sealing member 120 may include a through hole 121 penetrating the sealing member 120. The third connecting pipe 255 may be inserted into the through hole 121. A diameter of the through hole 121 may be larger than an outer diameter of the third connecting pipe 255.

Figure 9:
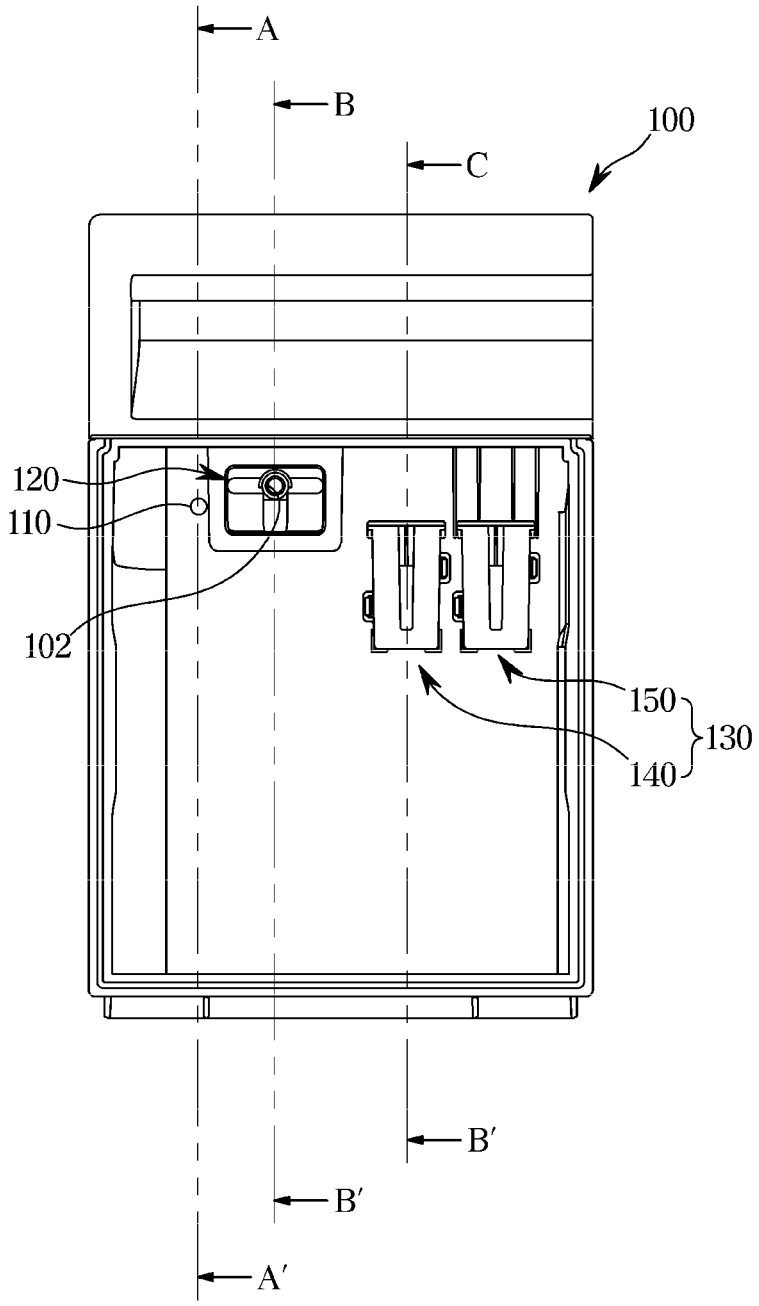
FIG. 9 is a front view of the drain container in the clothes care apparatus according to an embodiment of the disclosure.

FIG. 9 is a front view of the drain container in the clothes care apparatus according to an embodiment of the disclosure.

Referring to FIG. 9, the overflow hole 110 disposed in parallel with the opening 101 described above may be provided inside the drain container 100.

The overflow hole 110 may allow water inside the drain container 100 to be discharged outside the drain container 100 when the water level inside the drain container 100 rises by a height at which the overflow hole 110 is formed. Water discharged through the overflow hole 110 may be collected in the second water collecting duct 220 through the second flow passage 240 described above.

The overflow hole 110 may be disposed lower than one end of the third connecting pipe 255 disposed inside the drain container 100. Hereinafter, the one end of the third connecting pipe 255 described above is referred to as an inlet 102. Water collected in the water collecting duct 200 through the inlet 102 may be introduced into the drain container 100 through the first flow passage 230.

Because the overflow hole 110 is disposed below the inlet 102, even when the water level inside the drain container 100 rises, water inside the drain container 100 is not discharged outside the drain container 100 through the inlet 102. That is, because the separate recovery flow passage 240 is provided, water may not be introduced into the drain flow passage 230. Conventionally, because the drain flow passage simultaneously performed the recovery flow passage function, water leaks into the machine compartment during the reverse flow of water in the drain container through the drain flow passage. In general, because various electrical components are disposed inside the machine compartment, inflow of moisture into the machine compartment is fatal for the clothes care apparatus, and thus the inflow of moisture into the machine compartment needs to be prevented. According to the disclosure, the above limitation may be prevented by providing the recovery flow passage independently of the drain flow passage. That is, water leakage in a process of discharging water into the water collecting duct through the recovery flow passage may be prevented.

Referring to FIG. 9, a water level sensor 130 may be provided inside the drain container 100. The water level sensor 130 may include a first water level sensor 140 and a second water level sensor 150 arranged side by side. These sensors will be described later.

Figure 10:
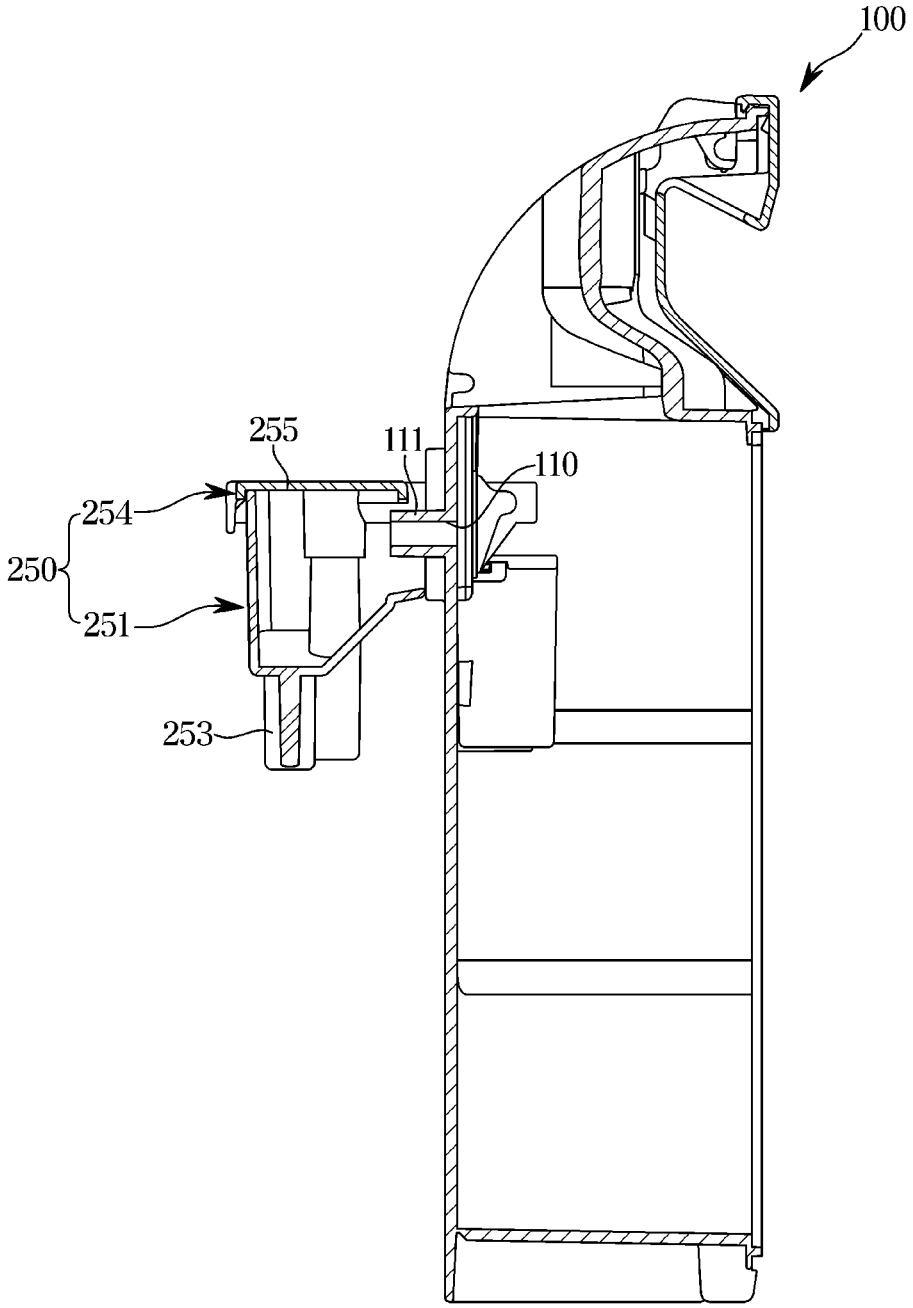
FIG. 10 is a cross-sectional view taken along line A-A' in FIG. 9.
Figure 11:
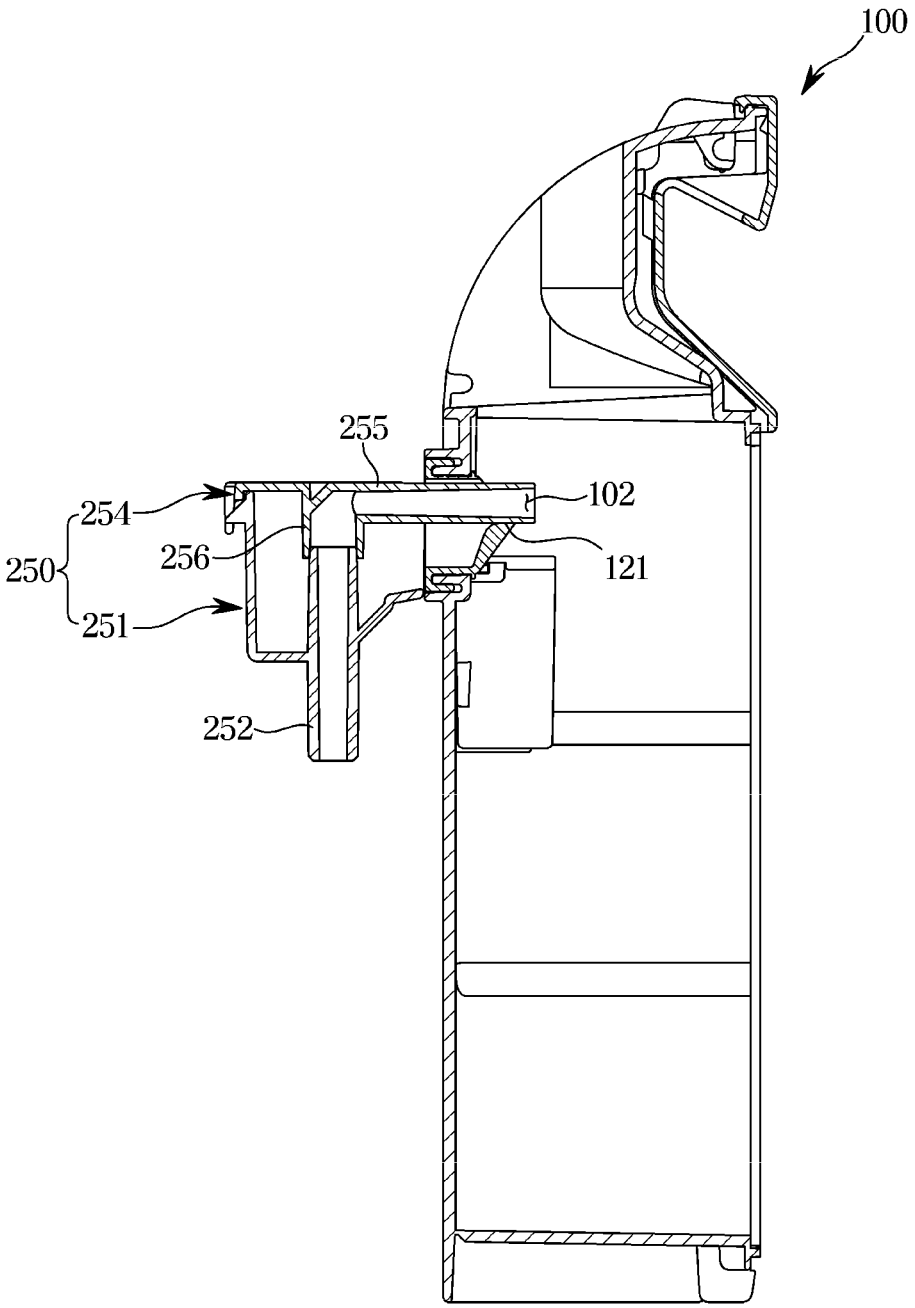
FIG. 11 is a cross-sectional view taken along line B-B' in FIG. 9.
Figure 12:
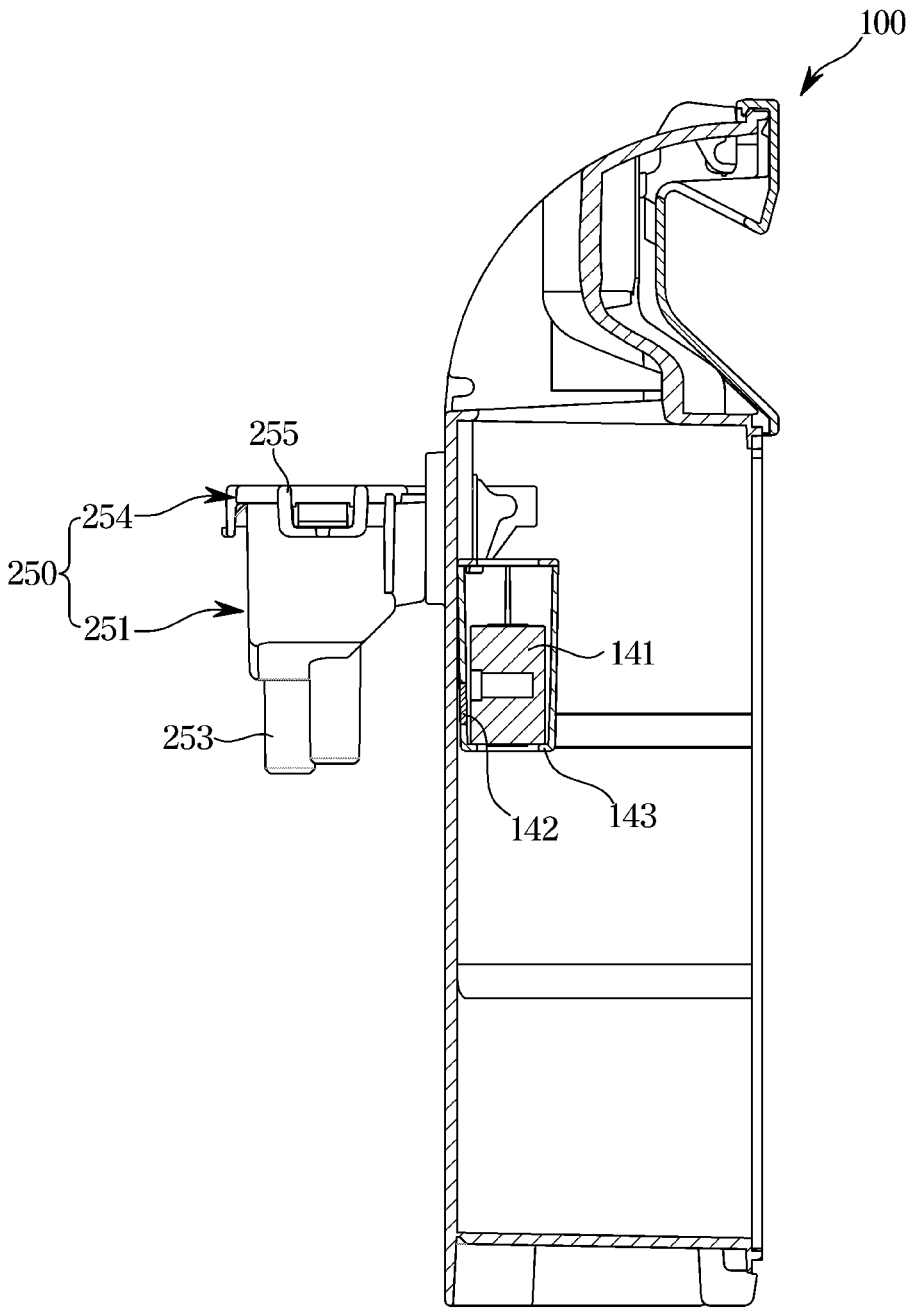
FIG. 12 is a cross-sectional view taken along line C-C' in FIG. 9.

FIG. 10 is a cross-sectional view taken along line A-A' in FIG. 9, FIG. 11 is a cross-sectional view taken along line B-B' in FIG. 9, and FIG. 12 is a cross-sectional view taken along line C-C' in FIG. 9.

The drain flow passage and the recovery flow passage according to an embodiment of the disclosure will be described in detail below with reference to FIGS. 10 to 12.

Referring to FIG. 10, when the water level in the drain container 100 rises and water starts flowing into the overflow hole 110, water introduced into the overflow hole 110 may be discharged to an end of the discharge pipe 111. Water discharged from the discharge pipe 111 may be introduced into an inner space of the body part 251 of the flow passage connecting member 250. Because a bottom surface of the body part 251 is inclined downward toward the second connecting pipe 253, water discharged into the inner space of the body part 251 may be guided by the bottom surface to be introduced into the second connecting pipe 253. The second connecting pipe 253 may be connected to the third hose 241 described above. Therefore, the water introduced into the second connecting pipe 253 may move to the second water collecting duct 220 through the third hose 241. The second flow passage 240 may collectively refer to the aforementioned water movement path.

Referring to FIG. 11, one end of the third connecting pipe 255 may be connected to one end of the first connecting pipe 252. The other end of the third connecting pipe 255 is disposed inside the drain container 100, and the other end of the third connecting pipe 255 is referred to as the inlet 102 in that it is a hole through which water is introduced into the drain container 100. The other end of the first connecting pipe 252 may be connected to the second hose 232 described above. Therefore, water pumped by the pump 61 may be discharged into the drain container 100 through the second hose 232, the first connecting pipe 252 and the third connecting pipe 255. The first flow passage 230 may collectively refer to a water movement path in which water is discharged from the second water collecting duct 220 into the drain container 100 through the first hose 231, the pump 61, the second hose 232, the first connecting pipe 252 and the third connecting pipe 255.

The through hole 121 of the sealing member 120 may have the diameter larger than the outer diameter of the third connecting pipe 255. This is to prevent the sealing member 120 from hindering the third connecting pipe 255 from being withdrawn from or inserted into the through hole 121 when the drain container 100 is separated from or coupled to the main body 10. When the through hole 121 is provided in the form of a slit, the sealing member 120 may be torn in a process of inserting the third connecting pipe 255 repeatedly into the through hole 121 or withdrawing from the through hole 121. When the sealing member 120 is torn, water may flow out through a torn gap of the sealing member 120. When water is introduced into the machine compartment 40 through this process, the electrical components of the clothes care apparatus 1 may malfunction. Therefore, in order to prevent the malfunction, the diameter of the through hole 121 of the sealing member 120 according to the disclosure may be larger than the outer diameter of the third connecting pipe 255.

The water level sensor 130 of the disclosure will be described below with reference to FIG. 12.

The first water level sensor 140 and the second water level sensor 150 may be the same. For convenience of description, only the first water level sensor 140 will be described below.

According to an embodiment of the disclosure, the first water level sensor 140 may be configured to detect a water level in the drain container 100 using a magnetic force.

Specifically, the first water level sensor 140 may include a floating magnet 141 provided to float in water, a detection sensor 142 disposed to face the floating magnet 141 when the floating magnet 141 is located in a predetermined position, and a magnet housing 143 provided to accommodate the floating magnet 141.

According to an embodiment of the disclosure, when the floating magnet 141 does not float on water to be located at a lower end of the magnet housing 143, the floating magnet 141 may face the detection sensor 142. When the floating magnet 141 does not float on water, a distance between the detection sensor 142 and the floating magnet 141 may be minimized. In this case, the magnetic force of the floating magnet 141 sensed by the detection sensor 142 may be maximized.

According to an embodiment of the disclosure, when the floating magnet 141 floats on water to be located at an upper end of the magnet housing 143, the floating magnet 141 may be far away from the detection sensor 142. When the floating magnet 141 floats on water, the distance between the detection sensor 142 and the floating magnet 141 may be maximized. In this case, the magnetic force of the floating magnet 141 sensed by the detection sensor 142 may be minimized.

Unlike the above, the detection sensor 142 and the floating magnet 141 may be provided such that the distance therebetween is minimized when the floating magnet 141 floats on water and maximized when the floating magnet 141 does not float on water.

The detection sensor 142 may detect whether the floating magnet 142 floats or not by detecting the magnetic force of the floating magnet 141. When the water level in the drain container 100 becomes a full water level, the floating magnet 141 may be located at the upper end of the magnet housing 142.

Figure 13:
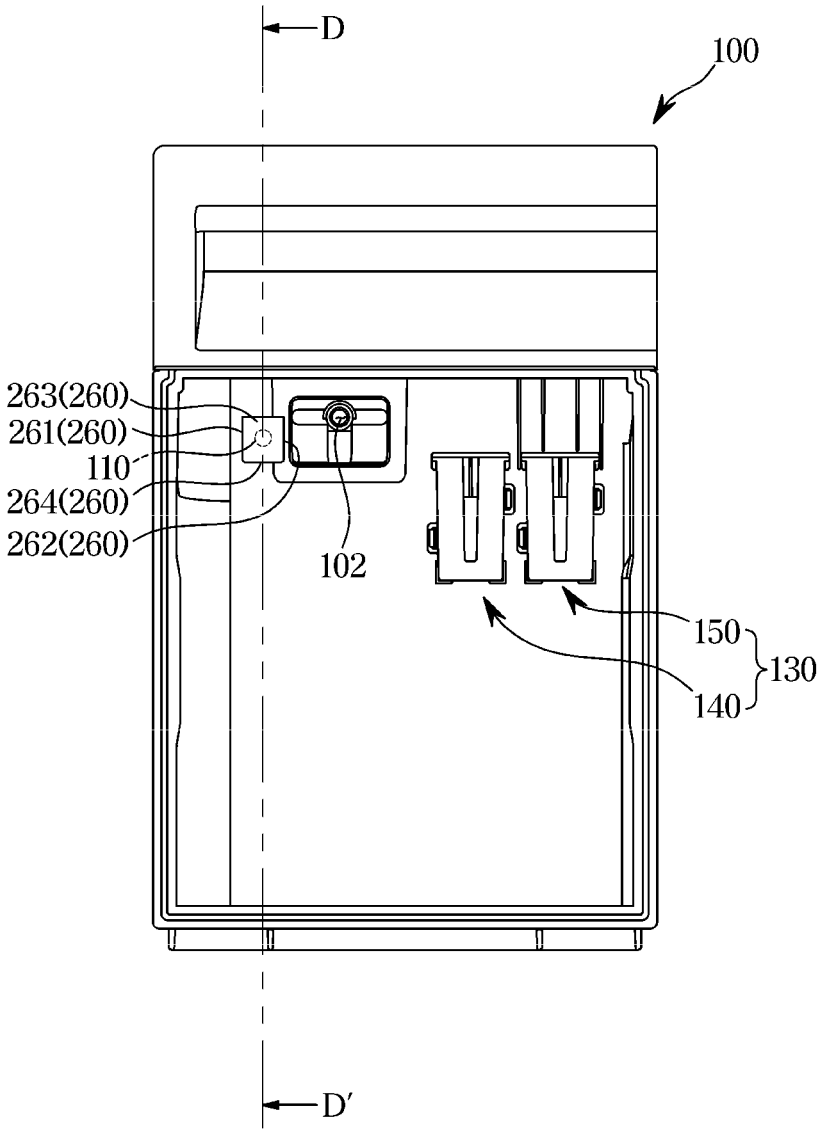
FIG. 13 is a front view of a drain container in a clothes care apparatus according to another embodiment of the disclosure.
Figure 14:
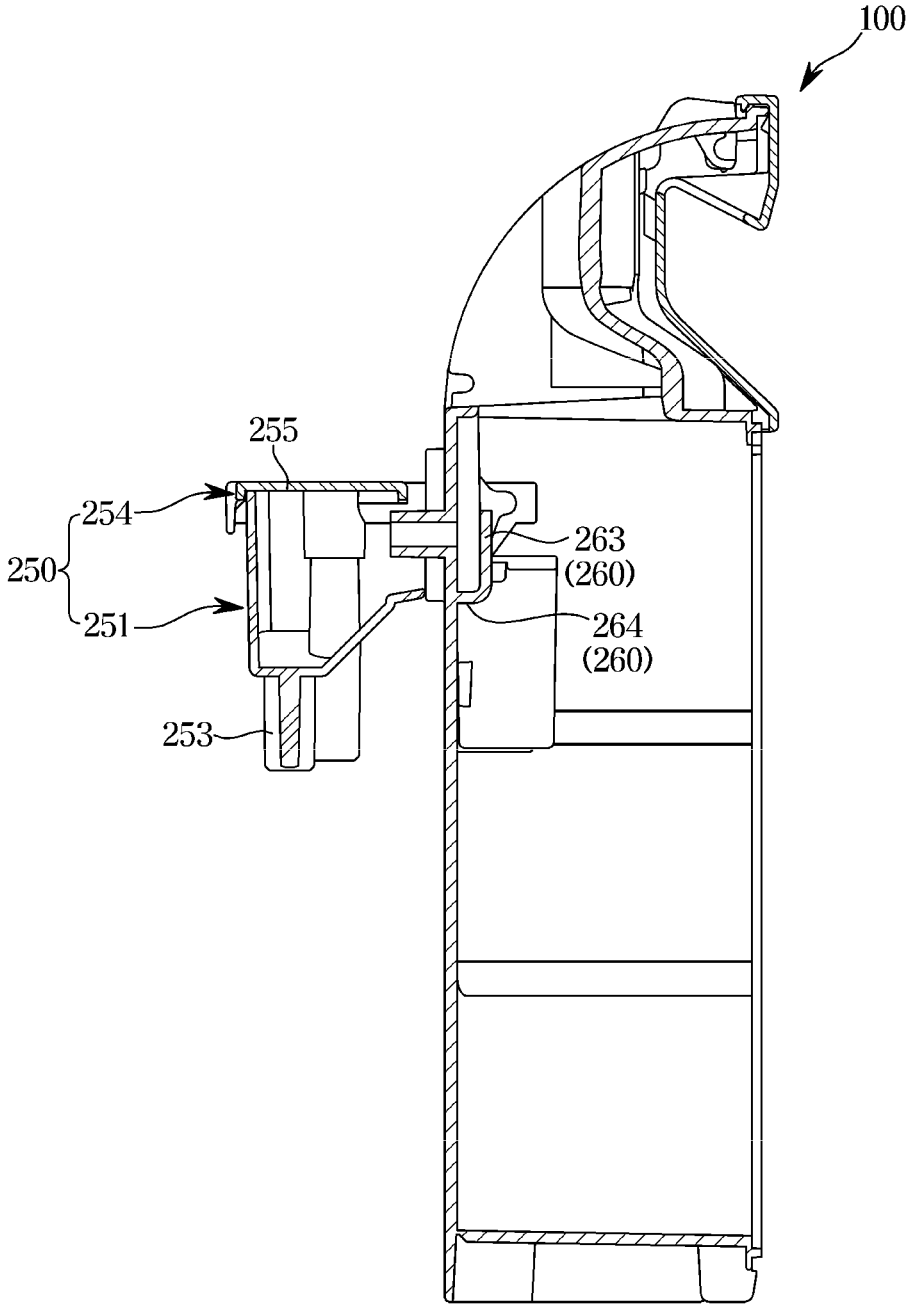
FIG. 14 is a cross-sectional view taken along line D-D' in FIG. 13.

FIG. 13 is a front view of a drain container in a clothes care apparatus according to another embodiment of the disclosure, and FIG. 14 is a cross-sectional view taken along line D-D' in FIG. 13.

Referring to FIGS. 13 and 14, a clothes care apparatus according to another embodiment of the disclosure may further include a partition wall 260 formed on an inner surface of the drain container 100.

The partition wall 260 may be formed to surround the overflow hole 110. The partition wall 260 may include a left wall 261 and a right wall 262 disposed on opposite sides of the overflow hole 110. The partition wall 260 may also include a front wall 263 facing the overflow hole 110, and a bottom wall 264 connecting the left wall 261, the right wall 262 and the front wall 263. An upper side of the partition wall 260 may be formed to be open.

The partition wall 260 may prevent water in the drain container 100 from being discharged through the overflow hole 110 unlike a user's intention. When the user separates the drain container 100 from the main body 10 to drain water in the drain container 100, the water in the drain container 100 may be discharged to the outside through the overflow hole 110 in a process of the user holding and moving the drain container 100. The partition wall 260 may prevent the discharge of water. However, in order to prevent water from being discharged to the inlet 102 without being discharged to the overflow hole 110 although the water level in the drain container 100 rises above the overflow hole 110 due to the partition wall 260, the open upper side of the partition wall 260 may be disposed below the inlet 102.

Figure 15:
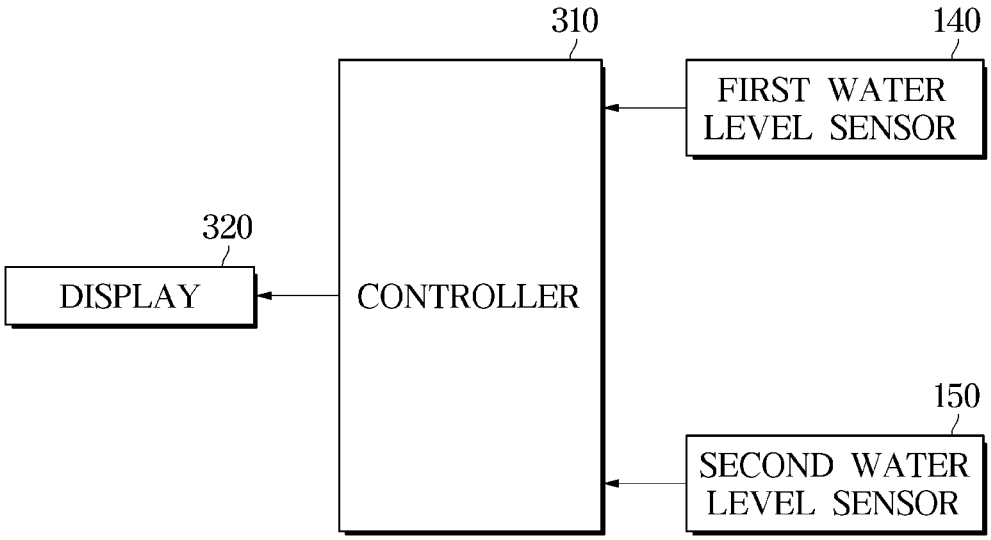
FIG. 15 is a control block diagram of the clothes care apparatus according to an embodiment of the disclosure.

FIG. 15 is a control block diagram of the clothes care apparatus according to an embodiment of the disclosure.

According to an embodiment of the disclosure, the water level sensor 130 may include the first water level sensor 140 and the second water level sensor 150 which are arranged side by side.

The first water level sensor 140 and the second water level sensor 150 may be configured identically, and the configuration thereof has been described above.

The clothes care apparatus 1 may include a display 320 configured to display a state of the first water level sensor 140 and/or the second water level sensor 150 or whether the water level in the drain container 100 is the full water level, and a controller 310 configured to control the display 320.

The controller 310 may receive information on the water level in the drain container 100 from the first water level sensor 140 and the second water level sensor 150.

According to the disclosure, the clothes care apparatus 1 may notify the user whether any one of the first and second water level sensors 140 and 150 is malfunctioning by including the first water level sensor 140 and the second water level detection sensor 150.

When the first water level sensor 140 and/or the second water level sensor 150 detects that the water level in the drain container 100 is the full water level, the controller 310 may control the display 320 to display the full water level or water emptying.

Also, when the first water level sensor 140 and/or the second water level sensor 150 detects the full water level even after the first water level sensor 140 and/or the second water level sensor 150 detects that the water level in the drain container 100 is the full water level and then a predetermined time has elapsed, the controller 310 may control the clothes care apparatus 1 to stop the operation of the clothes care apparatus 1.

When the first water level sensor 140 does not detect the full water level and the second water level sensor 150 detects the full water level, the controller 310 may control the display 320 to display information that the first water level sensor 140 is malfunctioning on the display 320. Accordingly, the user may recognize that the first water level sensor 140 is malfunctioning and may repair or replace the first water level sensor 140.

When the first water level sensor 140 detects the full water level and the second water level sensor 150 does not detect the full water level, the controller 310 may control the display 320 to display information on the display 320 that the second water level sensor 150 is malfunctioning. Accordingly, the user may recognize that the second water level sensor 150 is malfunctioning and may repair or replace the second water level sensor 150.

Figure 16:
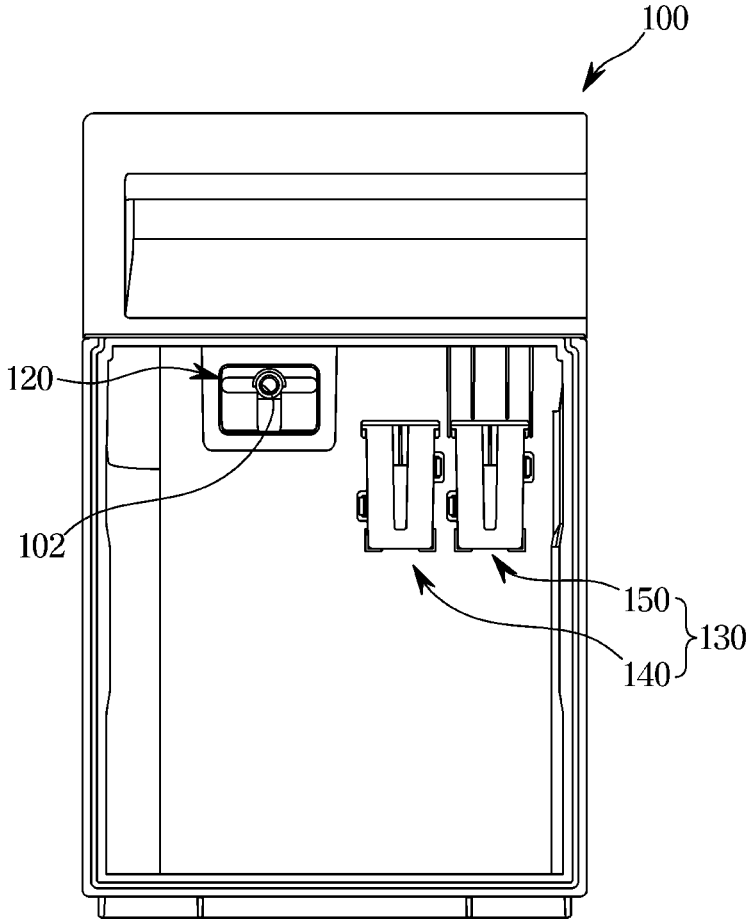
FIG. 16 is a front view of a drain container in a clothes care apparatus according to another embodiment of the disclosure.

FIG. 16 is a front view of a drain container in a clothes care apparatus according to another embodiment of the disclosure.

Referring to FIG. 16, in a clothes care apparatus according to another embodiment of the disclosure, the drain container 100 may not include an overflow hole.

As described above, the first water level sensor 140 and the second water level sensor 150 may be installed inside the drain container 100.

When the water level sensor is malfunctioning, a prior art does not provide a means for detecting the malfunction, and thus the user may not recognize the malfunction of the water level sensor. When the water level sensor does not detect the full water level, the clothes care apparatus continues to operate. When the clothes care apparatus continues to operate even though the water level in the drain container has reached the full water level, the water level in the drain container rises above the full water level.

According to an embodiment of the disclosure, when the water level in the drain container rises above the full water level, water in the drain container may be discharged to the water collecting duct through the recovery flow passage described above.

However, when the first water level sensor 140 and the second water level sensor 150 are provided, the user may recognize the malfunction of the water level sensor, and the operation of the clothes care apparatus may stop even when the user does not take action. Therefore, even when an overflow hole and a recovery flow passage including the overflow hole are not provided, the probability that the water level in the drain container rises above the full water level is very low.

According to another embodiment of the disclosure, in view of the above, the overflow hole and the recovery flow passage including the overflow hole may be omitted.

As is apparent from the above, the disclosure can provide a clothes care apparatus capable of detecting a malfunction of a water level sensor disposed inside a drain container and notifying a user of the malfunction.

Further, the disclosure can provide a clothes care apparatus in which a drain flow passage for transferring water from a duct to a drain container and a recovery flow passage for transferring water from the inside of the drain container to the duct are provided, and the drain flow passage and the recovery flow passage are independent of each other.

While the disclosure has been particularly described with reference to exemplary embodiments, it should be understood by those of skilled in the art that various changes in form and details may be made without departing from the spirit and scope of the disclosure.

What is claimed is:

1. A clothes care apparatus comprising:

a main body;

a heat exchanger disposed inside the main body and configured to condense air inside the main body;

a water collecting duct configured to collect water condensed on the heat exchanger;

a pump configured to pump out the water collected in the water collecting duct;

a drain container configured to store the pumped water introduced from the water collecting duct, the drain container comprising:

an inlet through which the pumped water is introduced into the drain container; and an overflow hole formed in the drain container to prevent the stored water from overflowing of the drain container by discharging the stored water through the overflow hole, the overflow hole disposed below the inlet;

a first flow passage through which the pumped water is introduced into the drain container from the water collecting duct through the inlet;

a second flow passage through which the stored water is discharged from the drain container to the water collecting duct through the overflow hole, the first flow passage and the second flow passage being independent of each other; and a water level sensor disposed inside the drain container, configured to detect a water level in the drain container, and disposed below the overflow hole a partition wall covering a periphery of the overflow hole to prevent water inside the drain container from being discharged through the overflow hole in response to the drain container being separated and moved from the main body.

2. The clothes care apparatus according to claim 1, wherein the first flow passage comprises a first hose extending from the water collecting duct to the pump so that the water collected from the water collecting duct is introduced to the pump through the first flow passage, and a second hose extending from the pump to the drain container so that the pumped water is introduced into the inlet of the drain container.

3. The clothes care apparatus according to claim 2, wherein the drain container further comprises:

an opening formed in parallel with the overflow hole; and a sealing member having a shape corresponding to the opening so that the sealing member is coupled to the opening to close and seal the opening, the sealing member having a through hole into which the pumped water is introduced into the inlet of the drain container.

4. The clothes care apparatus according to claim 3, further comprising a flow passage connector coupled to a rear of the drain container to correspond to the sealing member and the overflow hole, comprising an outlet formed on a bottom surface of the flow passage connector, and configured to guide the stored water introduced through the overflow hole to be discharged to outside of the drain container through the outlet.

5. The clothes care apparatus according to claim 4, wherein the second flow passage comprises a third hose connecting the outlet of the flow passage connector to the water collecting duct to discharge the stored water introduced through the overflow hole.

6. The clothes care apparatus according to claim 1, wherein the water collecting duct is a first water collecting duct and the clothes care apparatus further comprises a second water collecting duct disposed below the first water collecting duct and configured to receive the collected water discharged from the first water collecting duct.

7. The clothes care apparatus according to claim 6, further comprising a connecting hose connecting the first water collecting duct and the second water collecting duct to guide the water collected in the first water collecting duct to the second water collecting duct.

8. The clothes care apparatus according to claim 1, wherein the water level sensor is a first water level sensor, and the clothes care apparatus further comprises a second water level sensor arranged side by side with the first water level sensor.

9. The clothes care apparatus according to claim 1, wherein the water level sensor comprises:

a floating magnet to be movable up and down with respect to the water level according to the water level in the drain container;

a detection sensor to face the floating magnet at a selected position to detect a distance from the floating magnet; and a magnet housing configured to accommodate the floating magnet.

10. The clothes care apparatus according to claim 8, further comprising a controller configured to control the clothes care apparatus to stop performing an operation of the clothes care apparatus in response to one or more of the first water level sensor and the second water level sensor detecting that the water level in the drain container reaching a full water level.

11. The clothes care apparatus according to claim 10, further comprising a display configured to display a status of the clothes care apparatus, wherein the controller controls the display to display information on the display that the first water level sensor is not operating normally in response to the first water level sensor not detecting the full water level and the second water level sensor detecting the full water level, or that the second water level sensor is not operating normally in response to the first water level sensor detecting the full water level and the second water level sensor not detecting the full water level.

12. The clothes care apparatus according to claim 8, wherein the second water level sensor is in parallel with the first water level sensor in the drain container.

13. The clothes care apparatus according to claim 4, wherein:

the flow passage connector comprises a connecting pipe having one end connected to the second hose and an other end passing through the through hole, the inlet of the drain container is formed in the other end of the connecting pipe, the other end of the connecting pipe is configured to be withdrawn from the through hole in response to separating the drain container from the main body or to be inserted into the through hole in response to coupling the drain container to the main body, and a diameter of the through hole is larger than an outer diameter of the connecting pipe so as not to hinder the connecting pipe from being inserted into or withdrawn from the through hole.

14. A clothes care apparatus comprising:

a main body;

a heat exchanger disposed inside the main body and configured to condense air inside the main body;

a water collecting duct configured to collect water condensed on the heat exchanger;

a pump configured to pump out the water collected in the water collecting duct;

a drain container configured to store the pumped water introduced from the water collecting duct, the drain container comprising:

an inlet through which the pumped water is introduced into the drain container; and an overflow hole formed in the drain container to prevent the stored water from overflowing of the drain container by discharging the stored water through the overflow hole, the overflow hole disposed below the inlet;

a partition wall covering a periphery of the overflow hole to prevent water inside the drain container from being discharged through the overflow hole in response to the drain container being separated and moved from the main body; and a water level sensor disposed inside the drain container, configured to detect a water level in the drain container, and disposed below the overflow hole.

15. The clothes care apparatus according to claim 14, wherein the partition wall comprises side walls, a front wall connecting the side walls, respectively, the front wall facing the overflow hole, and a bottom wall connecting the side walls and the front wall, respectively, and an open upper side of the partition wall is disposed below the inlet.

* * * * *